US005330581A

United States Patent [19]

Syrinek

[11] Patent Number: 5,330,581

[45] Date of Patent: Jul. 19, 1994

[54] USE OF CAUSTIC AND SURFACTANT AS A CLEANER FOR RECYCLED PLASTIC

[75] Inventor: Allen R. Syrinek, Richmond, Tex.

[73] Assignee: Nalco Chemical Company, Naperville, Ill.

[21] Appl. No.: 935,855

[22] Filed: Aug. 26, 1992

[51] Int. Cl.[5] ..... B08B 3/04; B08B 3/08; C11D 7/12; C11D 1/66

[52] U.S. Cl. ..... 134/22.17; 134/22.1; 134/22.11; 134/22.13; 134/22.14; 134/22.17; 134/25.1; 134/25.4; 134/29; 134/40; 252/DIG. 1

[58] Field of Search ..... 134/22.1, 25.1, 25.4, 134/22.13, 22.14, 22.17, 29, 22.11, 40; 252/DIG. 1

[56] References Cited

U.S. PATENT DOCUMENTS 4,434,069 2/1984 Fairchild ..... 134/22.17
4,508,635 4/1985 Clarke ..... 252/DIG. 1
4,624,803 11/1986 Balzer et al. ..... 252/DIG. 1
5,055,139 10/1991 Personette ..... 134/22.17

FOREIGN PATENT DOCUMENTS 0264280 4/1988 European Pat. Off. .
203281 10/1983 German Democratic Rep. .
52-5686 1/1977 Japan .
827598 10/1982 South Africa .
2026551 2/1980 United Kingdom .

*Primary Examiner*—Richard O. Dean
*Assistant Examiner*—Zeinab El-Arini
*Attorney, Agent, or Firm*—Robert A. Miller

[57] ABSTRACT

A method for cleaning plastic objects, especially for recycling, whereby liquid surfactant and liquid caustic are added as separate feed streams to water to create a cleaning solution. The concentrations of surfactant and caustic in the cleaning solution are periodically monitored so that the feed rates can be adjusted as necessary to maintain the optimum concentrations of each component.

2 Claims, No Drawings

USE OF CAUSTIC AND SURFACTANT AS A CLEANER FOR RECYCLED PLASTIC

BACKGROUND OF THE INVENTION

1. Field of the Invention

This invention relates to the cleaning of plastics, especially for purposes of recycling. More specifically, this invention comprises a method by which a liquid surfactant and a liquid caustic are separately introduced into the cleaning phase of a recycling system so as to increase the cleaning efficiency while reducing the presence of foam.

2. Related Art

Plastic recycling is a relatively new industry which is currently experiencing tremendous growth. Recent concerns about the environmental impact of plastic use and disposal, as well as recent legislation, have led to a widespread demand for recycling used plastic products into new, usable consumer goods. Plastics are a petroleum product, and concerns about oil conservation have also led to a demand to recycle post-consumer plastic rather than meeting demand with new plastic products.

Since the recycling business is relatively new, there are few standard methods for recycling plastics, and improved means for accomplishing any recycling step are constantly sought. While there are few industry standards, a typical recycling business collects used plastic products, and then sorts them according to the type and color of the plastic. The sorted plastics are then shredded by some means into small plastic chips or flakes. These chips must then be cleaned to remove any dirt, oil, food particles, labels, glue, or other contaminants which may be present. The clean chips are then usually pelletized, or somehow organized in a usable form for a plastic manufacturer.

The chips are usually cleaned by a continuous flow process which introduces an aqueous cleaning solution and agitates and scrubs the plastic chips to remove contaminants. Some recycling businesses employ a batch process for cleaning. The cleaning process has been generally operated at a temperature of about 190° F. After cleaning, the chips have been typically moved on to a drying process, while the cleaning solution has been filtered, recycled, and renewed for further use. The renewal process has usually involved filtering the cleaning solution to remove glue and paper, followed by a blowdown of about 10% of the old solution, and then adding some fresh solution and recycling the solution to the cleaning phase.

Typically, the cleaning solution has contained a surfactant with sufficient cleaning properties to clean the plastic chips, and sufficient caustic compound to maintain an alkalinity adequate to remove labels and glue. Few commercial cleaning products are offered specifically for cleaning plastics in a recycling process. A general discussion of the effectiveness of several commercially available detergents for cleaning polyethylene chips is provided by Dr. Sidney Ranking, Ph.D. in "Technical Report #14: Process Simplification-Washing Technology", published by Rutgers University Center for Plastics Recycling Research, 1988. That article examines and compares several detergents, some of them household dishwashing detergents, which the solid either as solids or highly concentrated liquids and must be dissolved in water to create a cleaning solution.

These commercially available detergents generally comprise both a surfactant and a caustic in constant weight percentages. Such detergents may be a hindrance if a mixture of plastics from various sources is to be cleaned by the same system. The only way to increase the effectiveness of a cleaning solution prepared with these detergents has been to add more detergent to the solution. Unfortunately, this practice can cause excessive foaming, which may not be adequately rectified by using anti-foam products; moreover, the cleaning solution may still be inadequate to clean a particular plastic.

There can also be a large unnecessary expense associated with the use of such detergents. If more caustic is needed in the cleaning solution to help remove glue and labels from the plastic, there is no way to add more caustic without also adding more surfactant to the solution. Conversely, if only a small amount of caustic is needed, there is typically no way to reduce the amount of caustic in the cleaning solution without changing detergents. Significant expense is involved in using the wrong quantities of an inadequate detergent, when a lesser amount of a different cleaning solution would satisfactorily clean the plastic. Thus there is a continuing need for a method for cleaning plastic which can be adequately modified to meet the needs of a particular recycling system, and for monitoring the cleaning solution to help ensure that a proper amount of cleaner is constantly present.

SUMMARY OF THE INVENTION

The above-noted and other drawbacks of the related art are overcome by providing a novel method for cleaning plastic objects which features the capability of adding surfactant and caustic to the cleaning solution at separate rates and adjusting the flow rates of both components as necessary. The expense and inconvenience of using a detergent with inflexible quantities of surfactant and caustic are eliminated.

Utilizing this invention, streams of liquid surfactant and liquid caustic are added separately to the wash water of a recycling system. The desired concentrations of surfactant and caustic are determined experimentally, and the flow rates of the two streams are set to maintain those concentrations in the wash water. The wash water is periodically monitored to determine the alkalinity and the concentration of surfactant. If necessary, the flow rates of either the liquid surfactant or liquid caustic can be adjusted to change the concentration of either component.

DETAILED DESCRIPTION OF THE INVENTION

As noted above, a typical cleaning solution includes a surfactant suitable for cleaning plastic and some type of caustic which raises the alkalinity of the solution and aids in the removal of any labels and glue which may have been attached to the plastic. The most effective concentrations of surfactant and caustic may very, depending on the cleaning system used to clean the plastic chips and the type of plastic being cleaned.

The present invention addresses this need for various concentrations of surfactant and caustic by introducing them separately into the cleaning solution. A cleaning solution, or wash water, is created by introducing separate feed streams of surfactant, caustic, and water. The effectiveness of this method is further increased by using liquid surfactant and liquid caustic, so that the concentration of either component can be easily adjusted. When the cleaning solution is recycled, small amounts of liquid surfactant, liquid caustic, and water are added at independent rates such that the concentrations remain approximately constant. This results in a cleaning solution which contains the optimum amount of surfactant and caustic to clean whatever plastic is currently being recycled.

Not only does the invention provide a more efficient cleaning solution, but it may also result in significant cost savings. In that regard, the need for caustic a cleaning solution may vary widely, depending upon the amount of glue and labels present in a particular assortment of plastic chips. If less caustic is needed, the flow rate may be reduced resulting in large savings. Additionally, the flow rate of caustic may be increased when necessary without also increasing the amount of surfactant in the wash water. As noted above, when commercially available detergents with a fixed content of surfactant and caustic are used for cleaning, the only way to increase the amount of caustic present also involves adding more surfactant, which is expensive and typically causes increased foaming.

If liquid surfactant and caustic are used, there is an additional advantage of convenience. For a continuous flow process, surfactant and caustic may be added to the recycling phase of the cleaning solution at predetermined individual rates to maintain the desired concentration of each chemical. When a change is required, the flow rate may easily be adjusted and the concentration in the cleaning solution will then eventually reach the new desired level.

The cleaning solution must contain an adequate surfactant to effectively clean the plastic while creating a minimal amount of foam. Too much foaming may tend to slow the cleaning process and may require the system to be shut down to remove excess foam. Similarly, failure to monitor and minimize foaming may require large amounts of anti-foaming chemicals which can be expensive. Preferred surfactants for the practice of this invention are nonionic surfactants with a hydrophilic lipophilic balance ("HLB") from about 9 to about 15.

Oxyalkylate surfactants are especially useful in the practice of this invention.

Oxyalkylates are organic adducts of ethylene oxide or propylene oxide and mixtures thereof. Preferred surfactants include, but are not limited to, alcohol oxyalkylates wherein the alcohol contains 8 to 16 carbon atoms, alkyl phenol oxyalkylates wherein the alkyl group contains 4 to 12 carbon atoms, alkyl phenol formaldehyde resin oxyalkylates wherein the alkyl group contains 4 to 12 carbon atoms, and oxyalkylate fatty acids wherein the fatty acids contain 12 to 22 carbon atoms, and blends thereof. An especially preferred surfactant is a blend of nonyl phenol oxyalkylates with HLB's ranging from 12 to 15, mixed with a 32 mole ethylene oxide adduct of castor oil. A blend of surfactants with various HLB's is preferred because such a mixture will be effective over a wide range of temperatures and for a variety of plastics.

The liquid caustic must provide sufficient alkalinity to remove glue and labels from the plastic chips. Suitable caustic include, but are not limited to, solutions of potassium hydroxide, sodium hydroxide, sodium silicate, sodium carbonate, and sodium metasilicate, and blends thereof. A preferred liquid caustic for this purpose is a solution of 33 wt. % sodium hydroxide and 15 wt. % potassium hydroxide.

Some initial experimentation may be necessary to determine the most effective concentration of each liquid, so that the feed stream rates can be set accordingly. Surfactant concentrations of about 75 to 200 ppm have proven to be very effective, but the optimum concentration may vary based on the recycling process used and the types of plastic being cleaned. For the caustic, a concentration should be used which yields an appropriate alkalinity for the cleaning solution. A solution p-alkalinity of about 0.3 to 0.4 has proven sufficient to remove labels from most standard plastic chips. Different concentrations of surfactant and caustic may be employed at various times, depending on the specific types of plastics being processed at such times. If the surfactant concentration results in excessive foaming, an anti-foaming agent such as hydrophobic silica or silicone may also be added in a separate feed stream in an amount effective to reduce the foaming. Two commercially available anti-foaming agents are produced by Nalco as Nalco 1090 and Nalco 5777.

Once optimum concentrations for surfactant and caustic are determined experimentally, the flow rates of their respective feed streams can be set so that the separate concentrations remain approximately constant. Samples of cleaning solution should be tested periodically to help ensure that the concentration of surfactant and the alkalinity of the cleaning solution are at their optimum levels. Two tests have been used with the invention to measure the concentrations of each component in the cleaning solution. These tests were used with a cleaning solution composed of a blend of nonyl phenol oxyalkylates with HLB's ranging from 12 to 15, and a 32 mole ethylene oxide adduct of castor oil as the surfactant and a solution of a 33 wt. % sodium hydroxide and 15 wt. % potassium hydroxide solution as the caustic. However, these tests may be easily adapted for use with any suitable surfactant or caustic.

Hydroxyl alkalinity or the ratio of hydroxyl to total alkalinity is the criterion used for caustic content (pH may also be used to determine caustic concentration). Standardized hydrochloric acid is used to titrate the cleaning solution to the phenolphthalein and bromocresol green end points. The hydroxyl alkalinity can then be determined, and more caustic added if necessary.

To determine hydroxyl alkalinity under this method, 10 milliliters of cleaning solution are diluted with 50 milliliters of deionized water. One or two drops of phenolphthalein indicator are added, which turns the mixture purple. This is then titrated with acid until clear, and the volume of acid required recorded. For the second titration, one or two drops of bromocresol green are added and titrated with acid until the solution turns yellow, and the volume of acid required is recorded.

Hydroxyl alkalinity can then be calculated using the formula:

$$N \times (P - M) \times 100 = \text{Hydroxyl Alkalinity}$$

where:

N = normality of acid

P = milliliters of acid to phenolphthalein endpoint

M = milliliters of acid to bromocresol green endpoint

The alkalinity ratio can be calculated using the formula:

$$\frac{P-M}{P+M} = \text{alkalinity ratio}$$

where:

P=milliliters of acid to phenolphthalein endpoint

M=milliliters of acid to bromocresol green endpoint

One way to determine the concentration of surfactant in the cleaning solution is to use the Mayer Reagent Test Method. Polyethylene glycols yield a turbid solution in the presence of potassium iodomercurate (Mayer reagent). The amount of polyethylene glycol can be determined from a standard curve of absorbance vs. concentration, established by measuring the absorbance of various concentrations in a test sample. The curve is created by testing the absorbance of several known concentrations of surfactant solution. For the surfactant mentioned above, a blend of nonyl phenol oxyalkylates with HLB's ranging from 12 to 15 and a 32 mole ethylene oxide adduct of castor oil, the preferred concentrations are 0, 10, 20, 30 and 40 ppm of surfactant in solution.

Mayer reagent can be created by dissolving 1.358 grams of $HgCl_2$ in 60 milliliters of water, and pouring that solution into a solution of 5 grams of KI in 10 milliliters of water. Water is added to the resulting blend to make 100 milliliters of solution. Five milliliters of Mayer reagent are added to five different 25 milliliter graduated cylinders. Then 0, 0.5, 1, 1.5 and 2 milliliters of a 500 ppm. solution of surfactant are added to the respective cylinders. Each cylinder is then topped off to the 25 ml. level by adding 20% NaCl in water, then mixed by inverting once. The absorbance of each cylinder may be determined by using a spectrophotometer. The Spectronic Mini Spec 20, sold by Bausch & Lomb has proven to be useful for this purpose. A plot of absorbance vs. concentration should produce a linear curve which can be used to determine the surfactant concentration of an unknown solution. The volume of the unknown which will give an absorbance in the linear range (0–40 ppm) is then determined experimentally. The concentration is then read from the graph, and the dilution factor is calculated to determine the actual concentration of the unknown.

For example, assume a 0.5 ml. sample size of cleaning solution has an absorbance in the linear range which corresponds to a concentration of 30 ppm. The dilution factor would then be 25 ml/0.5 ml. This yields a concentration of 30×25/0.5 or 1500 ppm surfactant in the cleaning solution. This test procedure may be used to periodically check the concentration of surfactant present in the cleaning solution, and adjustments may be made to the feed stream, if necessary.

The effectiveness of this method for cleaning post-consumer plastics is demonstrated by the following example:

Tests were run at a recycling business which was using an industrial detergent to clean polyethylene terephthalate ("PET") plastic chips. The cleaning process was a continuous flow process as described above.

The surfactant chosen was a blend of nonyl phenol oxyalkylates with HLB's ranging from 12 to 15 and a 32 mole ethylene oxide adduct of castor oil. Through experimentation, it was determined that a surfactant concentration of 75 to 200 ppm should be used. Higher concentrations did not improve the quality of the cleaned plastic chips, and resulted in too much foaming. It was further determined that a constant flow rate of 3 to 4 gallons of surfactant per day was adequate to maintain the desired concentration.

The caustic chosen was a solution of 33 wt. % sodium hydroxide and 15 wt. % potassium hydroxide. The caustic rate was started initially at a rate which would yield a p-alkalinity of 0.7, which was the p-alkalinity of the dissolved industrial detergent that the recycling business had been using. However, through further experimentation it was found that a p-alkalinity of 0.3 to 0.4 was sufficient to clean the PET chips. A flow rate of about 33 gallons per day maintained this p-alkalinity.

A comparison of the plastic chips cleaned by this method to chips cleaned using the dissolved detergent showed some improvement in the quality of the plastic chips cleaned utilizing the present invention. The ability to reduce the concentration level of caustic in the cleaning solution resulted in a significant savings for the recycling business. There was also less need for an anti-foaming agent, as the foam level was controlled by decreasing the amount of surfactant used.

While various modifications and changes will be apparent to one having ordinary skill in the art, such changes are included in the spirit and scope of this invention as defined by the appended claims.

What is claimed is:

1. A method for cleaning plastic objects comprising the steps of:

mixing a stream of liquid surfactant solution and a stream of liquid caustic solution with water, the concentration of said surfactant in the mixture being capable of cleaning the plastic objects and the concentration of said caustic in the mixture being capable of removing glue and labels from the plastic objects; and contacting the plastic objects with said mixture under conditions suitable to remove glue and labels from the plastic objects and to clean the plastic objects;

monitoring the concentration of said surfactant in said mixture by mixing a sample of said mixture with potassium iodomercurate and determining the absorbance of said sample;

monitoring the concentration of said caustic in said mixture; and adjusting the flow rates of said liquid surfactant stream and said liquid caustic stream to maintain the concentrations of said surfactant and said caustic in the mixture effective to remove said glue and said labels from said plastic objects.

2. A method for cleaning post-consumer plastic objects comprising:

mixing a stream of alkyl phenol oxyalkylate with an HLB ranging from about 9 to about 15 as a liquid surfactant and a stream comprising a solution of sodium hydroxide and potassium hydroxide as a liquid caustic with water;

contacting the plastic objects with said mixture under conditions suitable to remove glue and glued labels from the plastic objects and to clean the plastic objects;

monitoring the concentration of said surfactant in said mixture by mixing a sample of said mixture with potassium iodomercurate and determining the absorbance of said sample; and monitoring the concentration of caustic in said mixture by titrating a sample of said mixture too determining the alkalinity of said sample, adjusting the flow rates of said liquid surfactant stream and said liquid caustic stream to maintain the concentrations in the mixture. effective to remove said glue and said labels from said plastic objects.

* * * * *